US008201281B2

(12) United States Patent
Hanifl et al.

(10) Patent No.: US 8,201,281 B2
(45) Date of Patent: Jun. 19, 2012

(54) TOILET BOWL TRAPPING DEVICE

(75) Inventors: Paul Hanifl, Barrington Hills, IL (US); Jeff Steffens, Cary, IL (US); Tim Moran, Rockford, IL (US)

(73) Assignee: Sage Products, Inc., Cary, IL (US)

( * ) Notice: Subject to any disclaimer, the term of this patent is extended or adjusted under 35 U.S.C. 154(b) by 421 days.

(21) Appl. No.: 12/533,782

(22) Filed: Jul. 31, 2009

(65) Prior Publication Data

US 2011/0023219 A1 Feb. 3, 2011

(51) Int. Cl.
*E03D 9/00* (2006.01)

(52) U.S. Cl. ..... 4/256.1; 4/DIG. 14

(58) Field of Classification Search ..... 4/256.1, 4/255.01, 255.04, 286–292, DIG. 14; 15/104.32, 15/104.05; 210/162, 446, 460; 43/65–66; 2/312

See application file for complete search history.

(56) References Cited

U.S. PATENT DOCUMENTS

| | | | | | |
|---|---|---|---|---|---|
| 561,576 | A | * | 6/1896 | Flannery | 2/302 |
| 733,102 | A | * | 7/1903 | Wilkinson | 2/312 |
| 875,973 | A | * | 1/1908 | Wood | 2/312 |
| 2,386,708 | A | * | 10/1945 | Morrison | 2/312 |
| 2,691,172 | A | * | 10/1954 | Breslow | 2/312 |
| 2,693,603 | A | | 11/1954 | Lehmann | |
| 2,705,328 | A | * | 4/1955 | Felix | 2/312 |
| 2,785,561 | A | | 3/1957 | Hoffman et al. | |
| 2,811,724 | A | * | 11/1957 | Click et al. | 4/256.1 |
| 2,974,324 | A | | 3/1961 | Lundelius | |
| 4,301,554 | A | | 11/1981 | Wojcicki | |
| 4,307,476 | A | | 12/1981 | Halstad | |
| 4,376,313 | A | | 3/1983 | Morgan | |
| 4,555,818 | A | | 12/1985 | Harrington | |
| 4,932,080 | A | | 6/1990 | Pino | |
| 5,027,447 | A | | 7/1991 | Pino | |
| 5,117,862 | A | | 6/1992 | Molligan | |
| 5,267,361 | A | | 12/1993 | Lai | |
| 5,546,614 | A | | 8/1996 | King, II | |
| 5,843,304 | A | | 12/1998 | Marchesseault et al. | |
| 6,668,389 | B1 | | 12/2003 | Steinmetz et al. | |
| 6,721,965 | B1 | | 4/2004 | Alston | |
| 6,802,085 | B2 | | 10/2004 | Catanescu et al. | |
| 7,096,516 | B1 | | 8/2006 | Moore, Jr. et al. | |
| 7,120,949 | B2 | | 10/2006 | Wilburn | |
| 7,150,050 | B2 | | 12/2006 | Sharp | |
| 7,383,594 | B1 | | 6/2008 | Giesken et al. | |
| 2009/0113613 | A1 | | 5/2009 | Kole | |

OTHER PUBLICATIONS

Hall, K., et al. "Potty Talk from Japan", Businessweek, Jan. 2, 2007:1-2 Downloaded http://www.businessweek.com/print/globalbiz/content/jan2007/gb20070102_511509.htm.

* cited by examiner

*Primary Examiner* — Charles Phillips
(74) *Attorney, Agent, or Firm* — Banner & Witcoff, Ltd.

(57) ABSTRACT

A trapping device for trapping non-dispersing cloths in a toilet bowl is disclosed. The trapping device comprises a strap, a plurality of hooks, and an adjustment buckle. The trapping device may be installed in a trapway of the toilet bowl. The strap has a first end, a second end, and a middle portion, wherein the second end includes a plurality of adjustment holes, and the middle portion is rounded. The plurality of hooks is attached to an inner wall of the strap, wherein the hooks extend at approximately 45-60 degrees away from the strap. The adjustment buckle is attached to the first end of the strap, wherein the second end of the strap slides through the adjustment buckle to adjust the diameter of the strap.

18 Claims, 11 Drawing Sheets

TOILET BOWL TRAPPING DEVICE

FIELD OF THE INVENTION

The present invention is directed towards a device for a toilet bowl, more specifically towards a trapping device for catching and retaining non-dispersing cloths in the toilet bowl.

BACKGROUND

Manufacturers produce disposable cloths used for personal cleaning, bathing, incontinence care, and disinfection. These cloths differ from other disposable hygiene products (such as toilet paper) in that they do not break down and disperse when in contact with water.

These non-dispersible cloths may be used in an environment where they are disposed of into a toilet. An accumulation of these cloths flushed down a toilet drain may eventually lead to a back up in the toilet, blockage of the wastewater drain system, malfunction of sewage pumps, accumulation in municipal sewers and wastewater treatment plants, or bursting of sewage pipes.

BRIEF SUMMARY OF THE INVENTION

The following presents a general summary of aspects of the invention in order to provide a basic understanding of at least some of its aspects. This summary is not intended as an extensive overview of the invention. It is not intended to identify key or critical elements of the invention or to delineate the scope of the invention. The following summary merely presents some concepts of the invention in a general form as a prelude to the more detailed description provided below.

In an aspect of the present invention, a trapping device for trapping non-dispersing cloths in a toilet bowl may comprise a strap, a plurality of hooks, and an adjustment buckle. The trapping device may be installed in a trapway of the toilet bowl. The strap may have a first end, a second end, and a middle portion, wherein the second end includes a plurality of adjustment holes, and the middle portion may be rounded. The middle portion may also include a polymer band located along a leading edge of a side of the middle portion, wherein the polymer band engages the bottom of the trapway of the toilet bowl. The plurality of hooks may be attached to an inner wall of the strap, wherein the hooks may extend at an angle approximately 45-60 degrees away from the strap.

The adjustment buckle is attached to the first end of the strap, wherein the second end of the strap slides through the adjustment buckle to adjust the diameter of the strap. The adjustment buckle further includes a front tab that prevents the trapping device from being pushed down the toilet bowl during routine operation. Additionally, the adjustment buckle includes a set of front guides configured to receive the second end of the strap, wherein the front guides are sized such that the hooks do not interfere with the front guides when the second end slides through the adjustment buckle. The adjustment buckle further comprises an adjustment connector that slides through the adjustment buckle and adjustment holes to secure the diameter of the trapping device.

In another aspect of this invention, the trapping device may be cemented to the toilet bowl. Additionally, in another aspect of this invention, the strap or hooks may be integral to the toilet bowl.

In another aspect of this invention, a system for trapping non-dispersing cloths in a toilet bowl may comprise a trapping device installed in the toilet bowl, and a disposable retrieval hook used to remove the trapped non-dispersing cloths from the trapping device. The trapping device may comprise: a) a strap having a first end, a second end, and a middle portion, wherein the middle portion is rounded; b) a plurality of hooks attached to the inner wall of the strap; and c) an adjustment buckle attached to the first end of the strap, wherein the second end of the strap slides through the adjustment buckle to adjust the diameter of the strap to match the diameter of the toilet bowl.

In another aspect of this invention, a toilet system for trapping non-dispersing cloths may comprise a toilet bowl with a trapway and a plurality of hooks integral to the toilet bowl. The hooks may be located at the trapway of the toilet bowl.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

The reader is advised that the attached drawings are not necessarily drawn to scale.

DETAILED DESCRIPTION OF THE INVENTION

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

Figure 4:
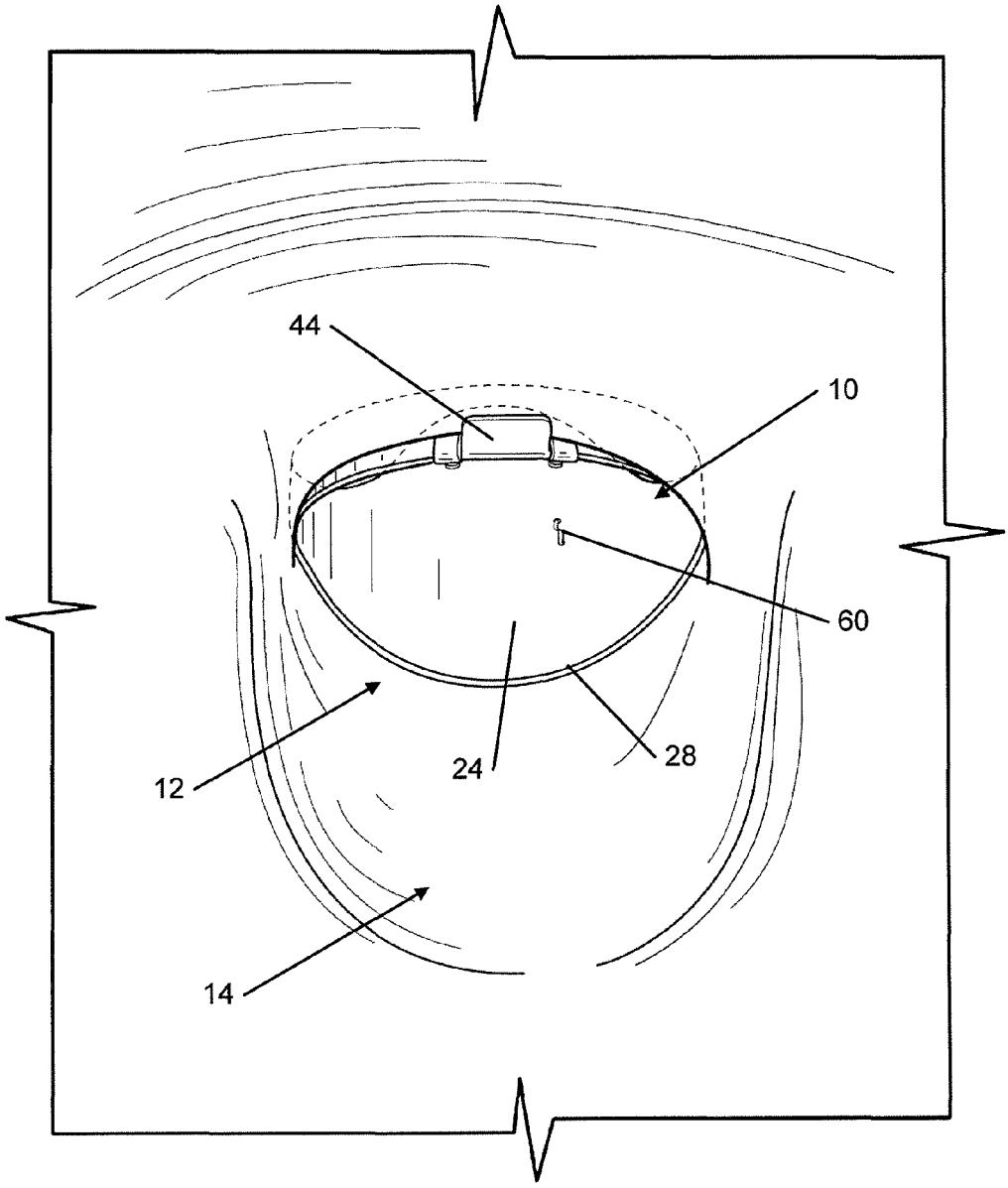
FIG. 4 illustrates a perspective view of the trapping device from FIG. 1A installed in a toilet bowl in accordance with this invention.
Figure 5:
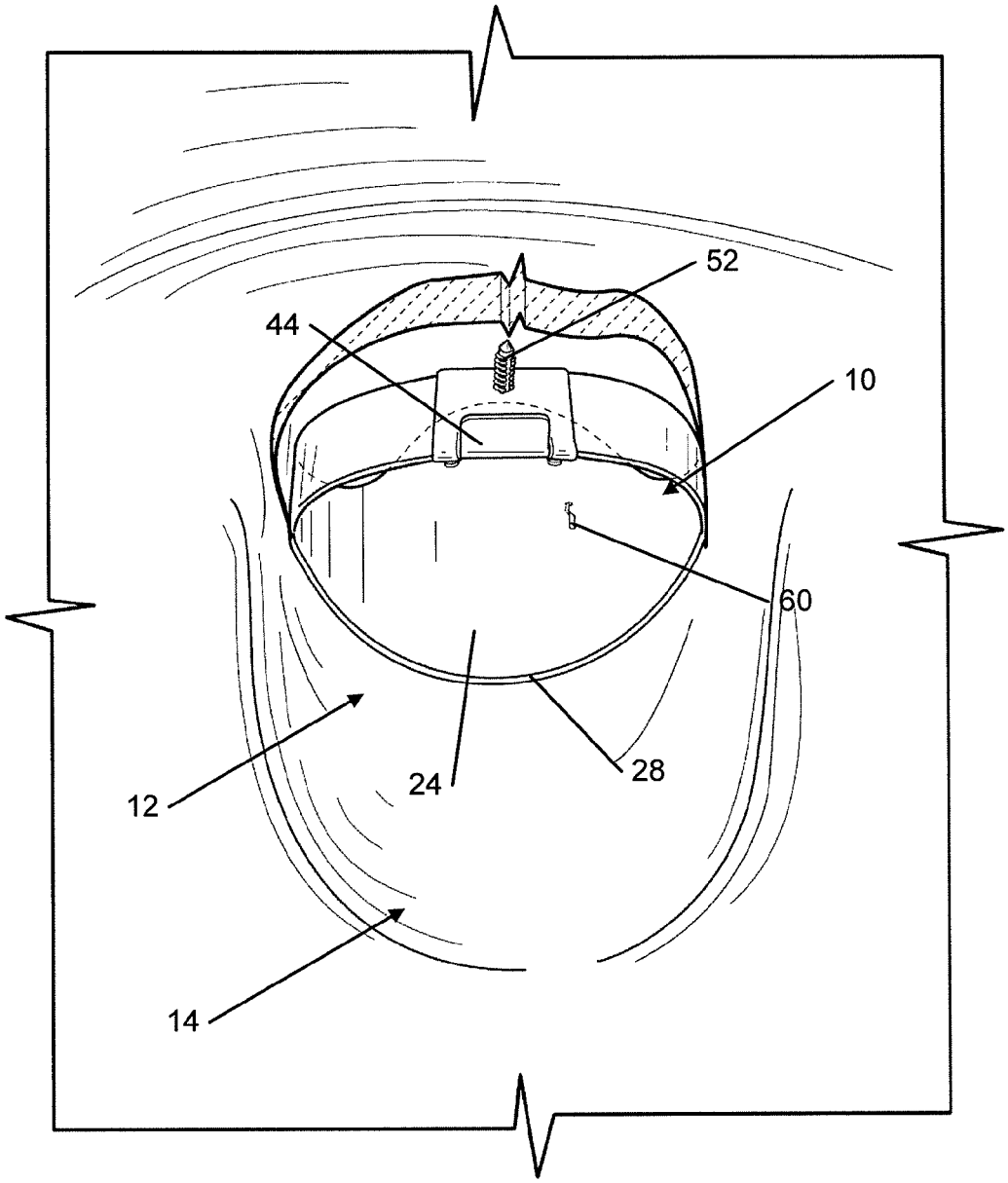
FIG. 5 illustrates a cut-out perspective view of the trapping device from FIG. 4 installed in the toilet bowl in accordance with this invention.

FIGS. 1A-3 illustrate a trapping device 10 for use in a toilet bowl 14 for trapping non-dispersing cloths. The trapping device 10 is comprised of a strap 20, an adjustment buckle 40, and a plurality of hooks 60. In one example in accordance with this invention, as illustrated in FIGS. 4 and 5 and discussed further below, the trapping device 10 is installed in a toilet bowl trapway 12 in the drain portion of the toilet bowl 14.

Figure 1A:
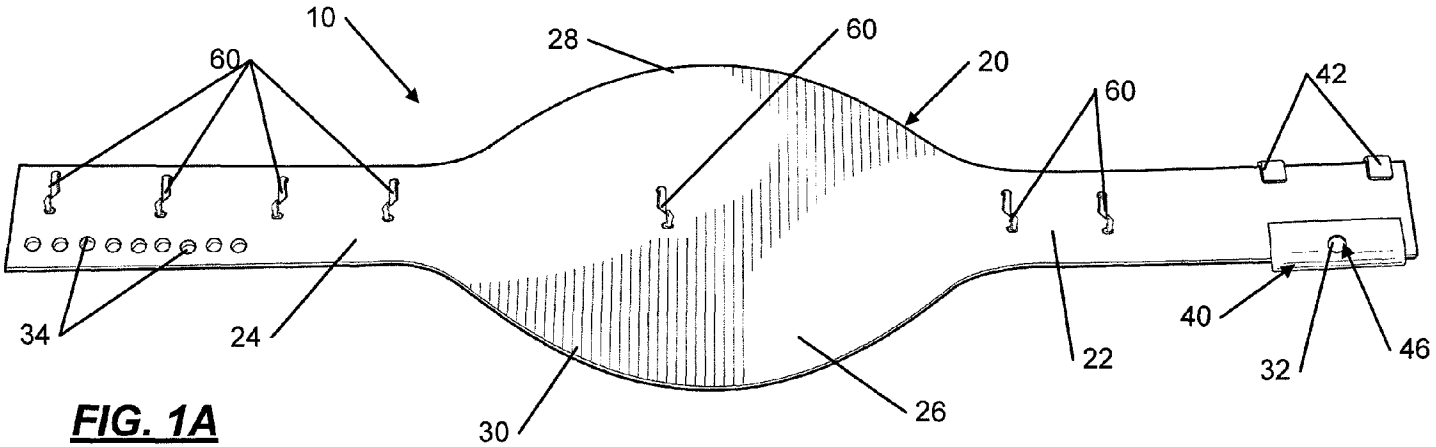
FIG. 1A illustrates a top plan view of the front side of an example trapping device in accordance with the present invention.
Figure 1B:
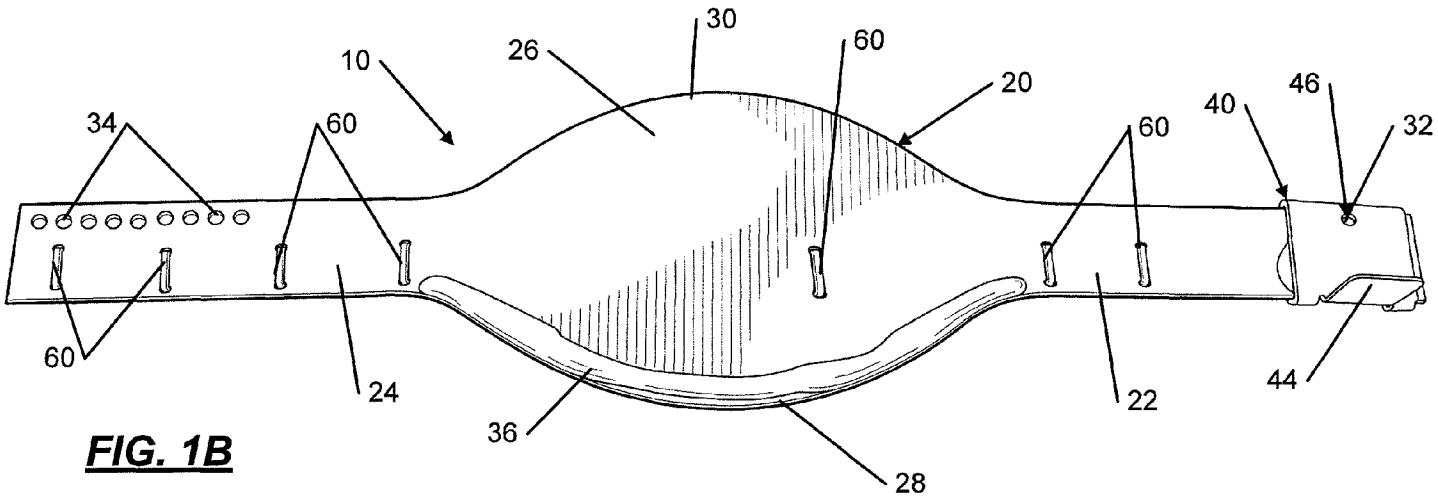
FIG. 1B illustrates a top plan view of the back side of the trapping device from FIG. 1A in accordance with this invention.
Figure 2A:
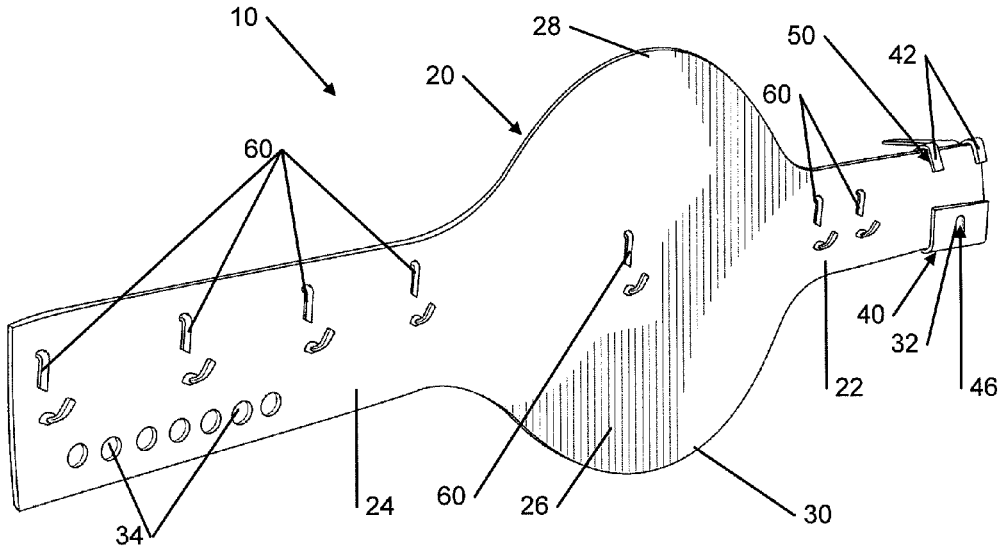
FIG. 2A illustrates a side perspective view of the front side of the trapping device from FIG. 1A in accordance with this invention.
Figure 2B:
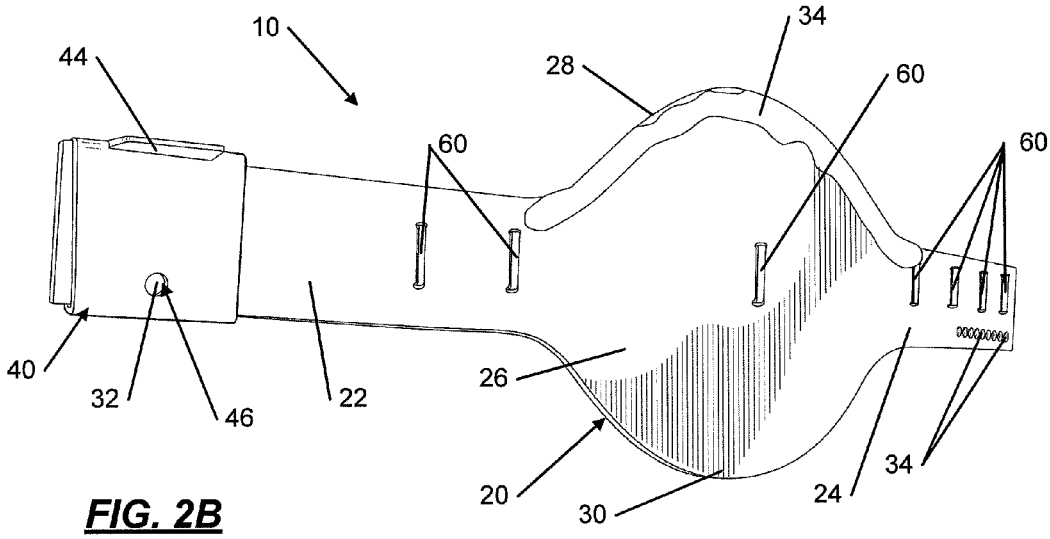
FIG. 2B illustrates a side perspective view of the back side of the trapping device from FIG. 1A in accordance with this invention.
Figure 3A:
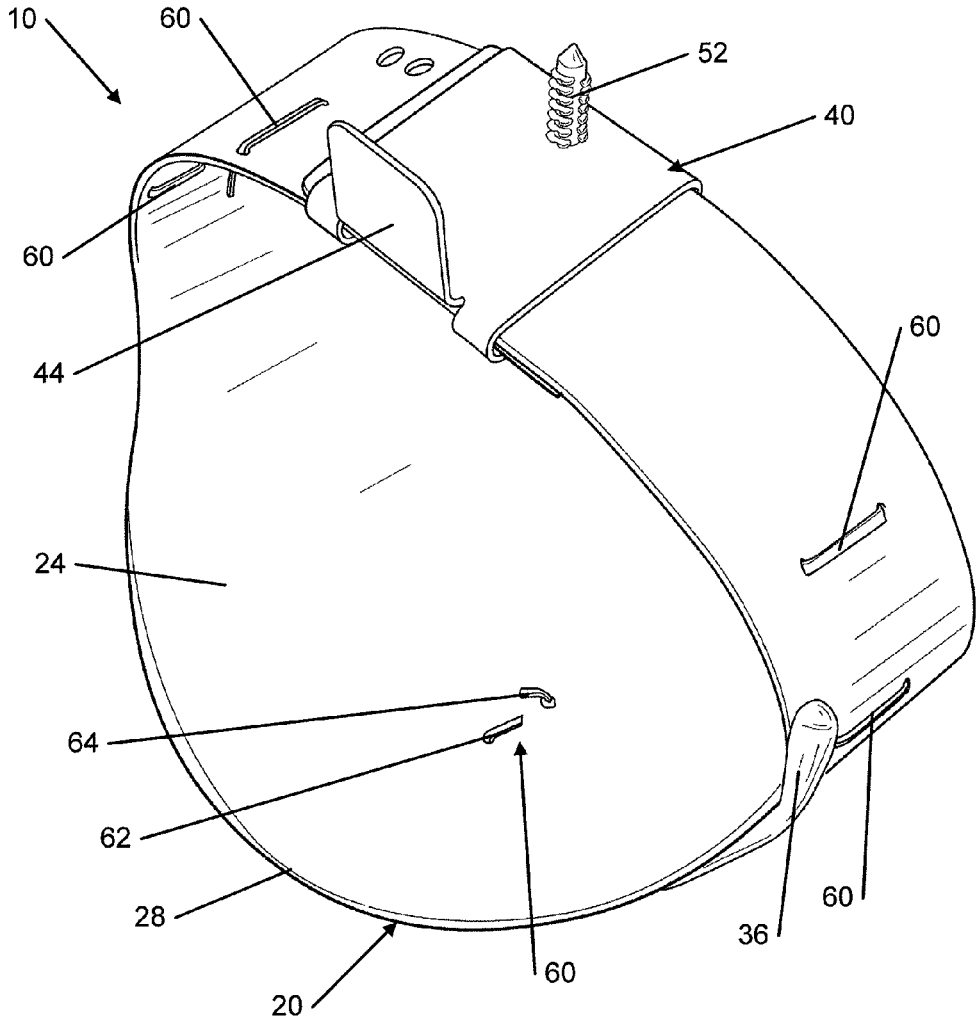
FIG. 3A illustrates a perspective view of the trapping device from FIG. 1A with both ends connected together in accordance with this invention.

As illustrated in FIGS. 1A-3A, the strap 20 may have a first end 22, a second end 24, and a middle portion 26 located in between the first end 22 and the second end 24. FIGS. 1A and 2A illustrate a top-view of the strap 20, while FIGS. 1B and 2B illustrate a bottom-view of the strap. FIG. 3A illustrates a view of the strap 20 with the ends 22, 24 connected together and prepared to be installed into the toilet bowl 14. The strap 20 has a leading edge 28 and a trailing edge 30 as illustrated in FIGS. 1A and 1B. The first end 22 and the second end 24 may be rectangular in shape, wherein the middle portion 26 may be many different shapes. In one example, as shown in FIGS. 1A and 1B, the middle portion 26 is rounded out on both the leading edge 28 and the trailing edge 30, such that the middle portion 26 may be somewhat similar to the shape of a football as can be seen in FIGS. 1A and 1B. The inventors have found that the rectangular shape for the first ends 22 and the second end 24 allow the flow of water through the toilet bowl 14 without obstructing the flow. The inventors have also found that the football shape middle portion 26 prevents the strap 20 and trapping device 10 from being sent down the drain of the toilet bowl 14 during routine operation. Additional shapes for the middle portion 26 are discussed later.

The strap 20 may be made of different materials without departing from the scope of the present invention. The strap material should allow the strap 20 to be able to fit within the various shapes of toilet bowls 14, yet also not fold or bend easily so that the strap 20 falls out of the trapway 12 of the toilet bowl 14. The strap 20 may be made of plastic, such as high density polyethylene (HDPE) to provide both strength and flexibility. Through testing by the inventor hereof, it has been found that using HDPE with a thickness between approximately 25-35 mil (0.025-0.035" thick) provides enough thickness to ensure that the trapping device 10 does not fold or bend easily, while also making the trapping device 10 thin enough to fit well within the majority of toilet bowl 14 configurations. In another exemplary embodiment, the strap may be approximately 30 mil HDPE. Alternatively, the strap 20 may be made of metal. While the strap 20 may be made of metal, some metals will corrode and rust when placed in a wet environment. The strap 20 may be made of a stainless steel that is non-corrosive in accordance with at least some examples of this invention.

The adjustment buckle 40 may be attached to the first end 22 of the strap 20 as will be discussed further below. Additionally, the first end 22 of the strap 20 includes a single hole 32. On the second end of the strap, there may be a plurality of adjustment holes 34. The cooperation of the adjustment buckle 40, the adjustment holes 34, and an adjustment connector 52 at the single hole 32 provides the user with the ability to adjust the diameter of the strap 20 to fit various sized toilet bowls 14, making the trapping device 10 adjustable and universal to various toilet bowls 14.

The middle portion 26 may also include a polymer band or strip 36 located along the leading edge 28 of one side, the under-side, of the middle portion 26. The band 36 may be made of a polymer substance or polymer bead, such as a hot-melt glue (e.g., 3M Jet melt adhesive, part#3764-AE). The band 36 may be in the shape of a narrow strip which extends along the leading edge 28 of the middle portion 26. The band 36 creates a seal between the trapping device 10 and the bottom of the toilet bowl 14, which diverts the water flow above and through the trapping device 10 rather than beneath the trapping device 10. The band 36 may be made of any similar substance or similar shape in accordance with examples of this invention as long as it diverts the water flow above and through the trapping device 10 rather than beneath the trapping device 10.

The adjustment buckle 40 may be attached to the first end 22 of the strap 20 by an epoxy or glue material bonding the strap 20 to the adjustment buckle 40. The adjustment buckle 40 may include a set of front guides 42, a front tab 44, an alignment hole 46 and an adjustment connector 52. The set of front guides 42 are located on the front side of the adjustment buckle 40 and may include one or more guides. The set of front guides 42 are bent 180 degrees from the adjustment buckle 40, thereby creating a slot 50 between the strap 20 and the adjustment buckle 40. When the adjustment buckle 40 is connected to the strap 20, the set of front guides 42 may be positioned such that the second end 24 of the strap 20 can slide through the slot 50. Additionally, the set of front guides 42 are sized such that the hooks 60 do not interfere with the adjustment buckle 40 when sliding the second end 24 of the strap 20 through the adjustment buckle 40 and while the hooks 60 are in an adjacent lateral position with the adjustment buckle 40. The front tab 44 may be located on the front side of the adjustment buckle 40 and may protrude from the adjustment buckle 40 perpendicularly. The alignment hole 46 is located on the adjustment buckle 40 on the side opposite the front tab 44. When the adjustment buckle 40 is installed on the strap 20, the alignment hole 46 lines up with one of the adjustment holes 34 on the second end 24 of the strap 20 to receive the adjustment connector 52. The adjustment connector 52 may be inserted through the alignment hole 46 on the adjustment buckle 40, one of the adjustment holes 34 on the second end 24 of the strap 20, and the single hole 32 on the first end 22 of the strap 20 when the first end 22 of the strap 20 is inserted into the adjustment buckle 40. The adjustment connector 52 may hold the adjusted size of the trapping device 10 in place. The adjustment connector 52 may be in the form of a rivet, a screw, or other connector in accordance with at least some examples of this invention.

The adjustment buckle 40 may be made of different materials without departing from the scope of the present invention. The adjustment buckle 40 should be made of a material that is non-corrosive so that the adjustment buckle 40 does not rust in the wet environment. Through testing, the inventors have found that 24-gauge 316 passivated stainless steel may be used as the material for the adjustment buckle 40. Additionally, other materials may be used for the material for the adjustment buckle 40 without departing from at least some examples of this invention, such as plastic or other non-corrosive metals.

Additionally, the adjustment connector 52 may be made of different materials without departing from the scope of the present invention. The adjustment connector 52 should also be made of a material that is non-corrosive so that the adjustment connector 52 does not rust in the wet environment. Through testing, the inventors have found that a plastic rivet may be used for the adjustment connector 52 (e.g., Pine-Tree Clip black, Thread Rite Screw Products, Part #M36 0300 02). Additionally, other materials, such as screws, pins, etc., may be used for the adjustment connector 52 without departing from at least some examples of this invention, such as stainless steel or other non-corrosive metals.

As shown in FIGS. 1A-3A, the plurality of hooks 60 are attached to the strap at various locations. The hooks 60 are used to catch and retain the non-dispersing cloths, while allowing other materials to pass by. The hooks 60 may be located on the first end 22 of the strap 20, the second end 24 of the strap 20, or middle portion 26 of the strap 20 or any combination thereof. Through testing by the inventor hereof, it has been found that the number, location, angle, and sharpness of the hooks 60 provides an optimal balance between catching the non-dispersing cloths, while allowing other materials to pass. The inventors have found that with too many hooks 60, the trapping device 10 then catches the non-dispersing cloths while also catching many of the undesirable toilet paper and waste. The inventors have also found that with using too few hooks 60, the trapping device 10 then does not catch all of or a significant percentage of the non-dispersing cloths. The inventors have found that the optimal number of hooks 60 to be installed on the strap 20 is between five and nine hooks 60, with less hooks 60 being used in the smaller version of the trapping device 10. In other embodiments in accordance with this invention, the number of hooks 60 can be outside the range of five to nine hooks. In an embodiment, at least five hooks are included. In another embodiment, no more than nine hooks 60 are included. In an alternative exemplary embodiment in accordance with this invention, the strap 20 may include seven hooks 60, with five or six hooks 60 being used in a smaller version of the trapping device 10. Additionally, in an embodiment, these hooks 60 may be located approximately an inch apart, with, for example, two hooks 60 located on the first end 22 of the strap 20, four hooks 60 located on the second end 24 of the strap 20, and one hook 60 located on the middle portion 26 of the strap 20, as shown in FIGS. 1A-2B. Additionally, the inventors have found that the hooks 60 may need to be forward enough, i.e. closer to the leading edge 28 of the strap 20, so that the non-dispersing cloths are visible to the user when the trapping device 10 is installed in the toilet bowl 14.

The angle of the hook 60 may also be important to catching and retaining the non-dispersing cloths while allowing other materials to pass. The inventors have found that the optimal angle for the hooks 60 is between approximately 45 and 60 degrees angled away from the strap 20 with the point of the hook 60 facing into the toilet bowl 14. When the hooks 60 are angled at 90 degrees, it was found that the cloths would catch and then fall off. In an embodiment in accordance with this invention, the angle of the hooks 60 is less than 90 degrees and greater than approximately 15 degrees. The number, location, and angle of the hooks 60 can vary without departing from at least some examples of this invention.

Figure 3B:
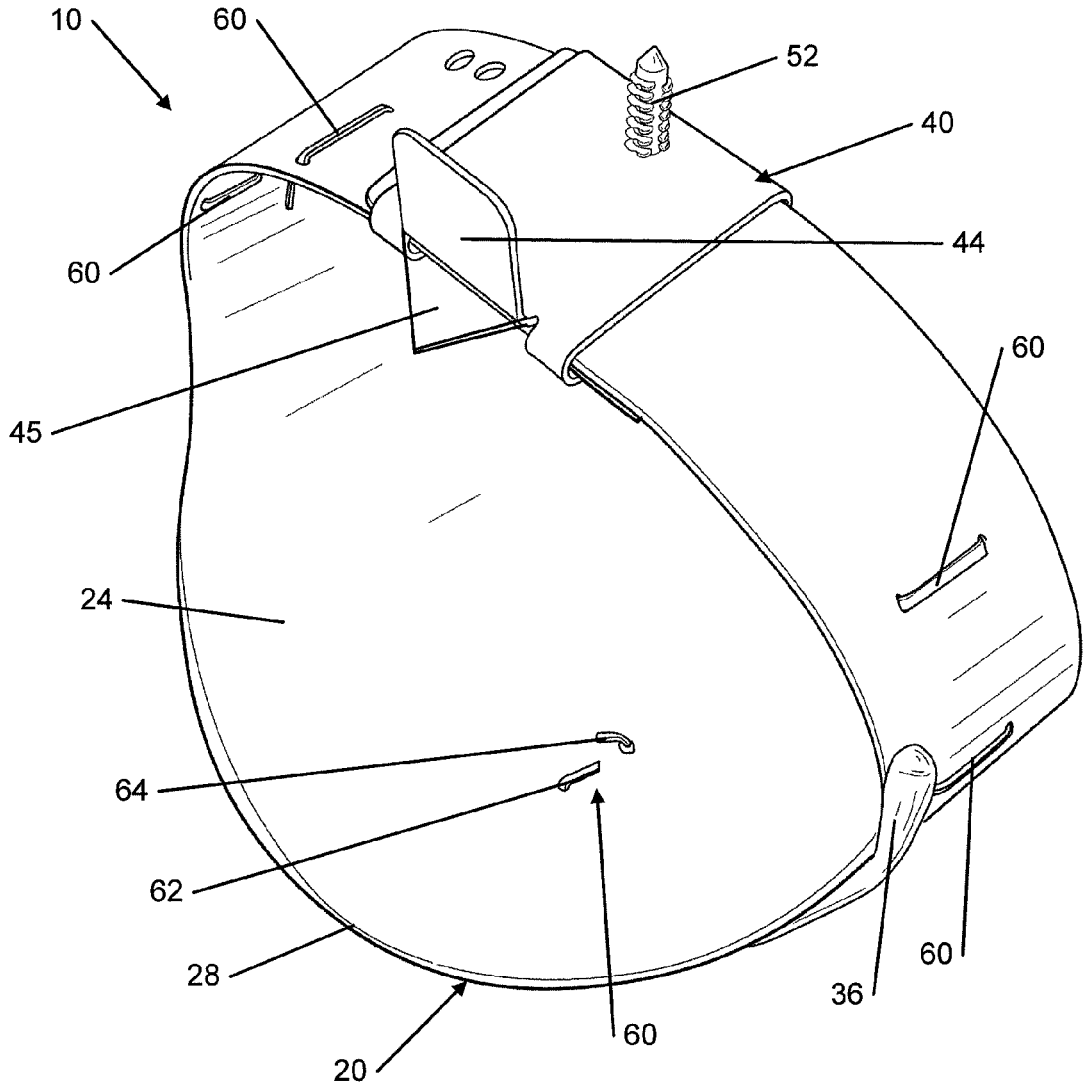
FIG. 3B illustrates a perspective view of the trapping device from FIG. 3A with a tooth in accordance with this invention.

The hooks 60 may be made of different materials without departing from the scope of the present invention. The hook material should be rigid and inflexible. The hook material should be able to remain substantially in position during toilet bowl cleaning, and if moved from position, go back into substantially the same position after the cleaning. Additionally, the hook material should be a non-corrosive material so that the hooks 60 do not rust in the wet environment. Also, the hooks 60 may be sharp, such as sharp enough to catch the non-dispersing cloths, while being able to break or cut through the toilet paper and waste in the toilet 14. Additionally, barbed hooks 60 may be used without departing from at least some examples of the invention. The barbed hooks 60 may have a "T" barb to catch the non-dispersing cloths. Additionally, the adjustment buckle 40 may include a tooth 45 which acts as another hook, as illustrated in FIG. 3B. The tooth 45 may extend from either front or back of the adjustment buckle 40. The tooth 45 may be triangular shaped. This tooth-type hook 45 may be used to enhance the ability of capturing different types and weights of cloths. This tooth-type hook 45 may be different shapes or in different locations without departing from this invention. Through testing, the inventors have found that a heavy duty staple may be used as the hooks 60 (eg., Surebonder 5/16" stainless steel, No. 4, heavy duty, T50). When the heavy duty staple is used for the hooks 60, the staple may be inserted into the strap 20 from the back side of the strap 20, with a first leg 62 and a second leg 64 of the staple protruding out of the front side of the strap 20. The first leg 62 of the staple may be bent to lay flat against the front side of the strap 20, while the second leg 64 may be bent to an angle between 45-60 degrees. Additionally, other materials may be used for the hook 60 material without departing from at least some examples of this invention, such as Velcro, fishing hooks, and plastic hooks. Each of these examples may have their drawbacks, but could be found effective if used in combination or in different numbers.

The trapping device 10, as described above, may be installed in a toilet 14 by a user. To install the trapping device 10, the user may first prepare the trapping device 10 for installation, as shown in FIG. 3A. To prepare the trapping device 10 for installation, the user may first insert the second end 24 of the strap 20 with the plurality of adjustable holes 34 into the slots 50 provided between the two front guides 42 of the adjustment buckle 40 and the first end 22 of the strap 20. The slots 50 on the back side of the strap 20 receive the second end 24 of the strap 20 which allows for size adjustment based on the size of the toilet bowl trapway 12. Because the size of toilets 14 vary, the user may size the trapping device 10 to properly fit the trapping device 10 into the toilet bowl trapway 12. Once the two ends 22, 24 of the strap 20 are adjusted to fit the toilet bowl trapway 12, the adjustment connector or rivet 52 may be inserted through the adjustment buckle 40, the single alignment hole 32, and the selected adjustment hole 34 on the second end 24 of the strap 20 to hold the adjusted size in place. The trapping device 10 as shown in FIG. 3A is prepared for installation into the toilet bowl 14.

Figure 10:
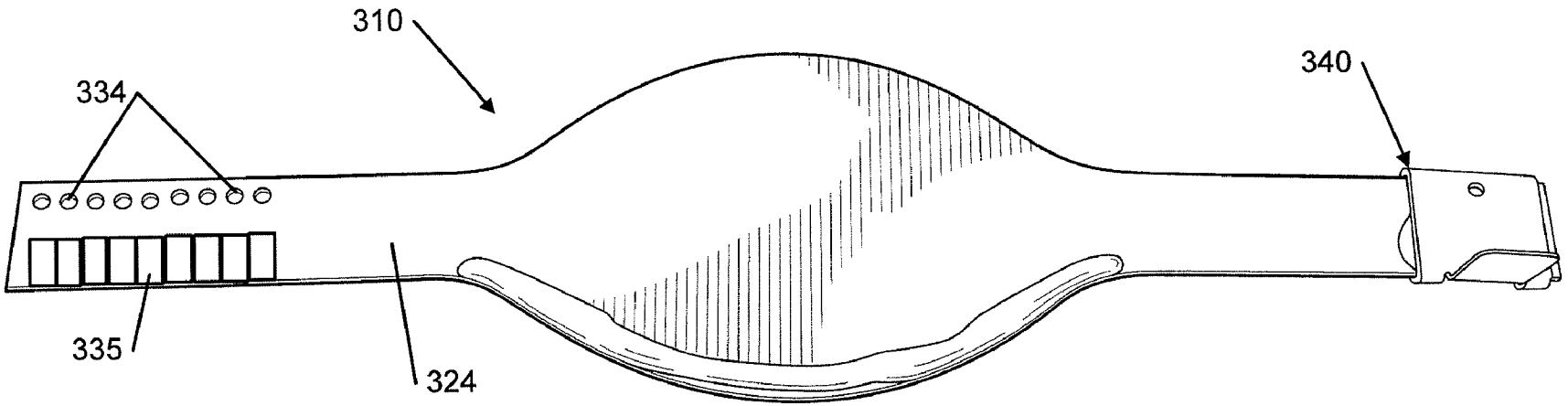
FIG. 10 illustrates a top plan view of an example sizing tool in accordance with this invention.

As illustrated in FIG. 10, when installing the trapping device 10 into the toilet bowl trapway, the user may first use a sizing tool 310. The sizing tool 310 is similar to the trapping device 10 as described above, without the hooks 60. The sizing tool 310 may include colors strips 335 that consist of multiple distinct colors that match up with each of the adjustment holes 334. The user may place the sizing tool 310 into the toilet bowl trapway 12 and expand the strap of the sizing tool fully in the drain by sliding the end of the strap 324 through the adjustment buckle 340. The user may then note the color 335 indicated on the sizing tool 310. The color 335 indicated on the sizing tool 310 may then correspond to an adjustment hole 34 on the trapping device 10, thus allowing the user to install the trapping device 10 into the trapway. This sizing tool 310 may be used with the installation of the trapping device 10, however, this sizing tool 310 is not required for the installation of the trapping device 10.

As illustrated in FIGS. 4 and 5, the user may install the trapping device 10 into the toilet bowl trapway 12. To install the trapping device 10 into the toilet bowl trapway 12, the user may first set the trapping device 10 at an angle with the top of the rivet 52 under the top side of the toilet bowl trapway 12. The user may then slide the trailing edge 30 of the middle portion 26 of the strap 20 into the bottom of the toilet bowl trapway 12. The band 36 on the under-side of the middle portion 26 of the strap 20 may create a seal with the bottom of the toilet bowl trapway 12, thereby helping water to flow over the trapping device 10, rather than under the trapping device 10. When the band 36 is seated against the bottom of the toilet bowl trapway 12, the front tab 44 is seated against the front portion of the top side of the toilet bowl trapway 12. With the front tab 44 seated in this location on the toilet bowl trapway 12, the trapping device 10 is prevented from being pushed into the drain during normal toilet bowl operations, such as flushing, and normal toilet bowl cleaning. Additionally, the shape of the middle portion 26 of the strap 20, the general football shape, helps prevent the trapping device 10 from being pushed down the drain during normal toilet bowl operations, such as flushing, and normal toilet bowl cleaning. The combination of the rivet 52, the front tab 44, and the shape of the middle portion 26 all help to keep the trapping device 10 in the proper location throughout the entire flushing process, with water exiting through the drain and water flowing upward after the flush to fill the toilet bowl 14. As illustrated in FIGS. 4 and 5, the leading edge 28 of the strap 20 may be the only part of the trapping device 10 that the user can see when the trapping device 10 is installed in the toilet bowl 14.

Additionally, as illustrated in FIGS. 4 and 5, the majority of hooks 60 may be located on the top and the sides of the installed trapping device 10. The hooks 60 may be located in this location so that they do not interfere with human waste. The single hook 60 on the bottom of the installed trapping device 10 is located on the bottom to prevent heavy cloths from slipping by the top hooks 60. Because of the weight, these heavy cloths are more capable of dropping to the bottom of the toilet bowl trapway 12 during the flushing, and thereby may be caught by the bottom hook 60 in the middle portion 26.

The color of the trapping device 10 has been found to be important when installed in the toilet bowl 14. Through testing, the inventors have found that a strap 20 with a color in contrast with the non-dispersing clothes is useful. For example, a black strap 20 contrasts with the caught white non-dispersing clothes for the user, who may be responsible for removing the caught cloths from the trapping device 10. The inventors found when using white plastic for the strap 20, the white strap 10 does not contrast enough with the white non-dispersible cloths and the white toilet bowl 14 and therefore it was hard to differentiate the caught cloths from the trapping device 10. Other colors may be used for the trapping device 10 or the strap 20 without departing from at least some examples of this invention, as long as the color contrasts with the white non-dispersible cloths.

Additionally, the user may utilize a disposable retrieval hook to retrieve the cloths that have been caught by the trapping device 10. The retrieval hook may be a metal or plastic hook designed to retrieve cloths from the trapping device 10.

Once installed, the trapping device 10 can also be removed from the toilet bowl 14. The user may need to use pliers or a similar tool to remove the trapping device 10 from the toilet bowl trapway 12 because of the close fit and the combination of the rivet 52 and the front tab 44 fit with the top of the toilet bowl trapway 12. Additionally, the trapping device 10 may be semi-permanently installed in the toilet bowl 14. This semi-permanent installation may be accomplished by using epoxy or cement or some other glue material without departing from the scope of this invention.

Figure 6A:
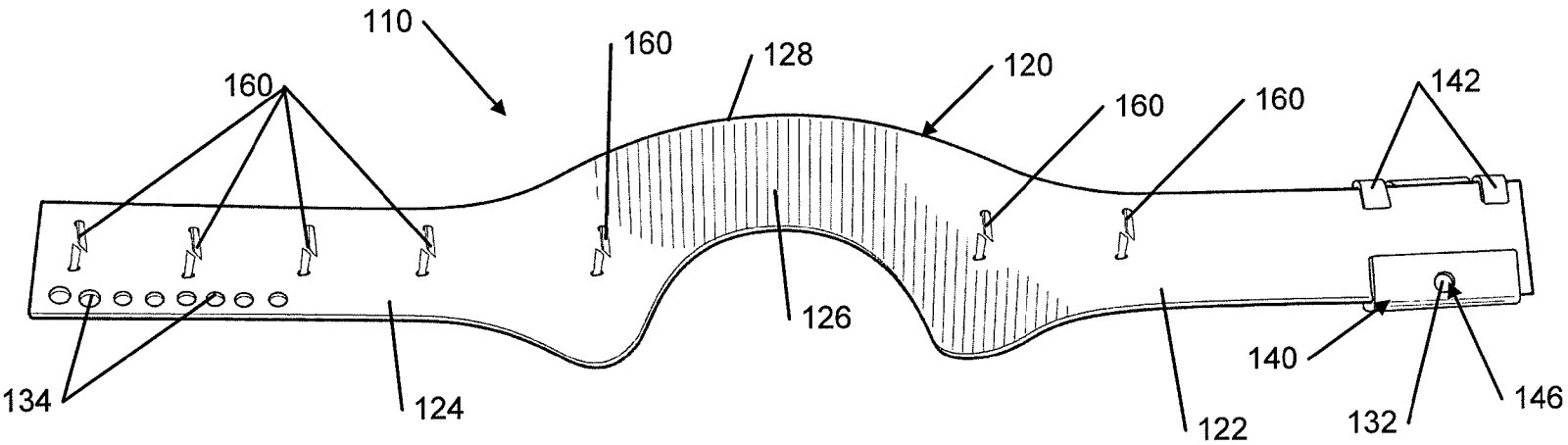
FIG. 6A illustrates a top plan view of the front side of an example trapping device for use in a toilet bowl with a jet-assist housing in accordance with the present invention.
Figure 6B:
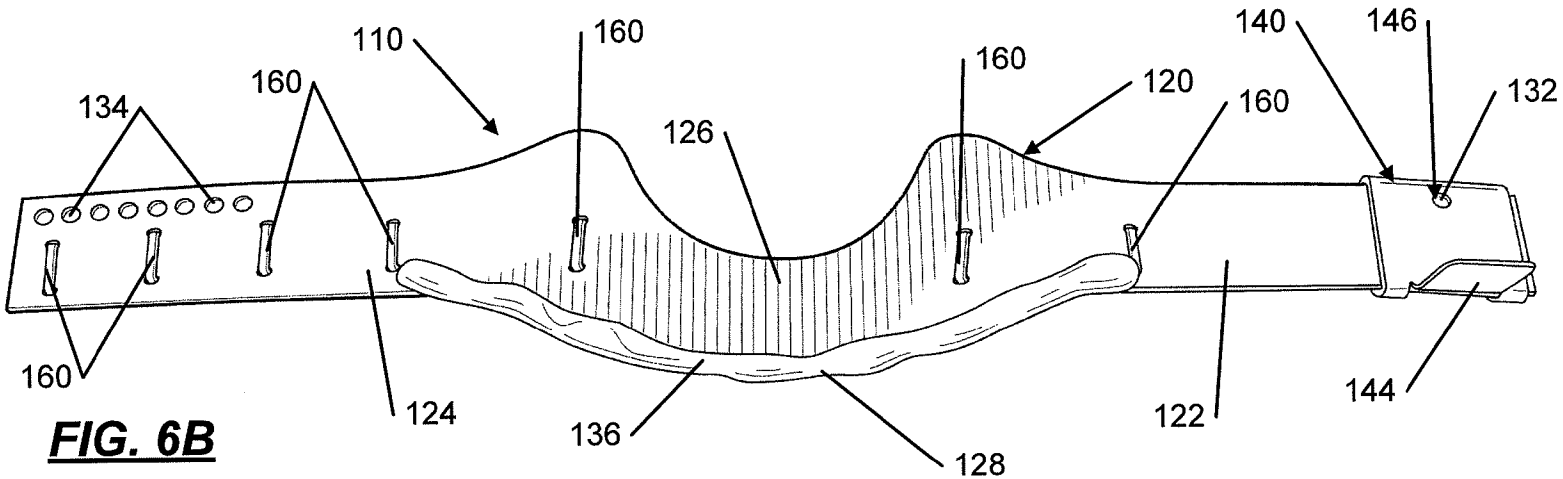
FIG. 6B illustrates a top plan view of the back side of the trapping device from FIG. 6A in accordance with this invention.
Figure 7:
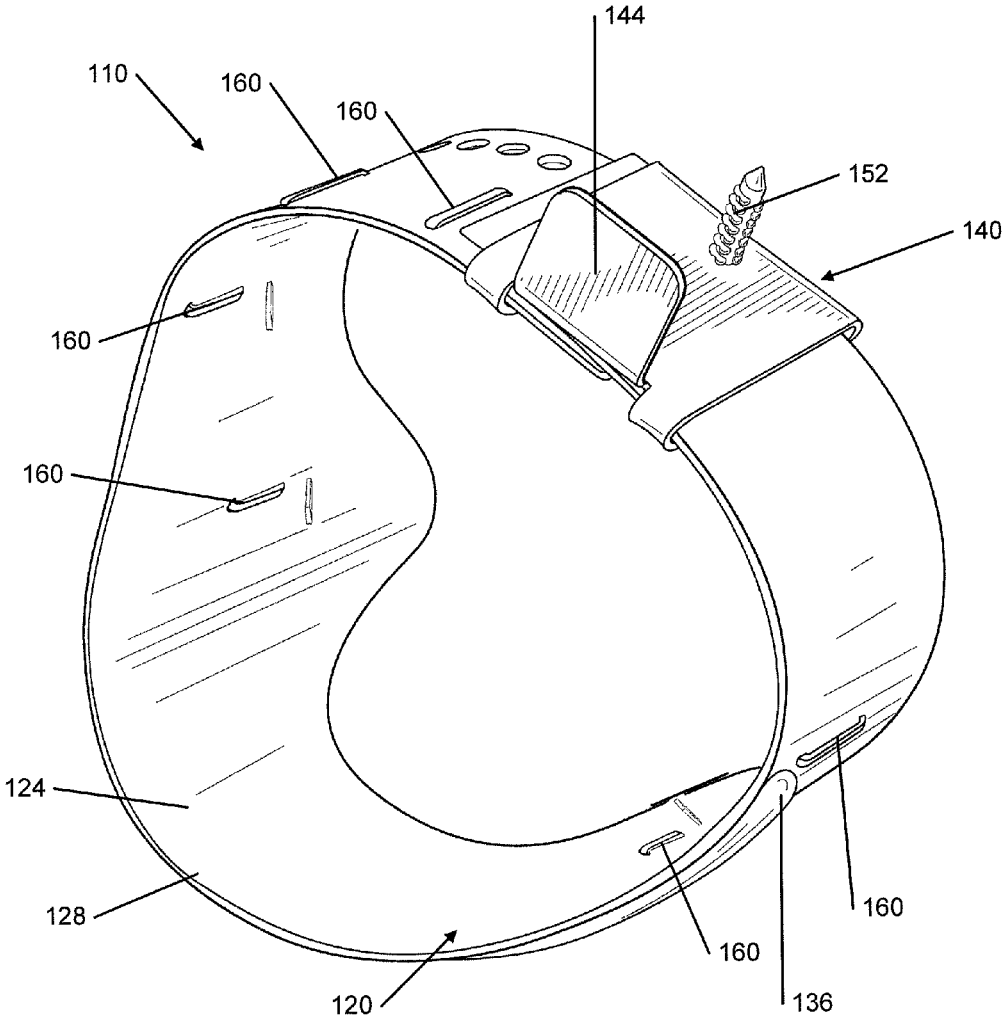
FIG. 7 illustrates a perspective view of the trapping device from FIG. 6A with both ends connected together in accordance with this invention.
Figure 8:
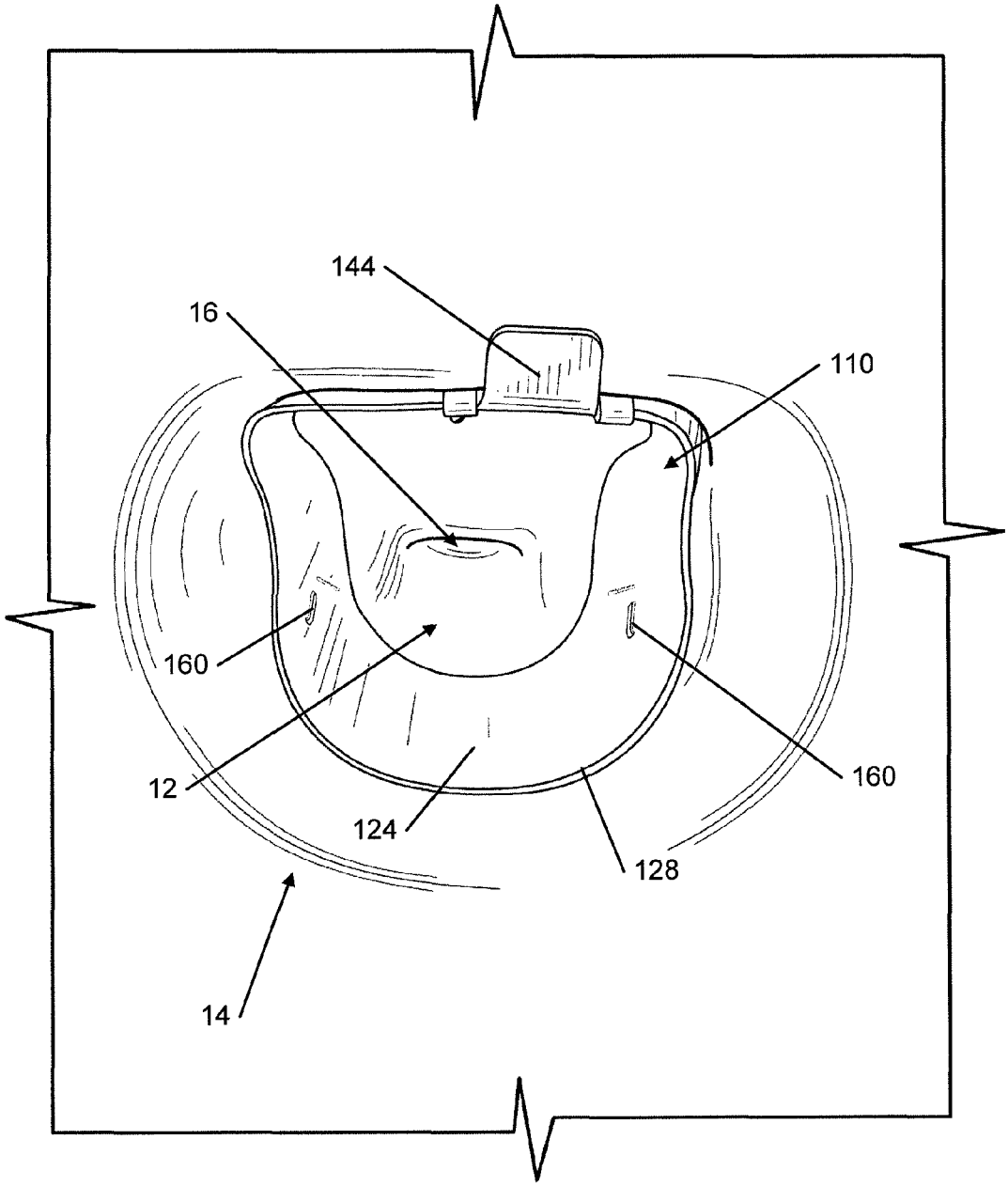
FIG. 8 illustrates a perspective view of the trapping device from FIG. 6A installed in a toilet bowl in accordance with this invention.

FIGS. 6A-8 illustrate an example combination according to this invention similar to that described above in conjunction with FIGS. 1A-5 (the same or similar reference numbers are used in FIGS. 6A-8 as those used in FIGS. 1A through 5 to denote the same or similar parts). FIGS. 6A-8 illustrate a trapping device 110 for a toilet bowl with a "jet-assist" housing 16 near the toilet bowl trapway 12. The jet-assist propels water into the trapway 12 to aid in clearing the toilet bowl 14. As FIGS. 6A-8 illustrate, the jet-assist trapping device 110 may have a section from the middle portion 126 that is cut away to accommodate the jet-assist housing 16. Additionally, the location of the hooks 160 may be slightly different because of the smaller middle portion 126. Similar to the trapping device 110 described above, the hooks 160 may be located approximately an inch apart, with one hook 160 located on the first end 122 of the strap 120, four hooks 160 located on the second end 124 of the strap 120, and two hooks 160 located on the middle portion 126 of the strap 120, as illustrated in FIGS. 6A and 6B. The two hooks 160 located on the middle portion 126 may be located on the middle portion 126 next to where the jet-assist housing 16 is located. The number, location, and angle of the hooks 160 on the strap 120 can vary without departing from at least some examples of this invention.

Figure 9A:
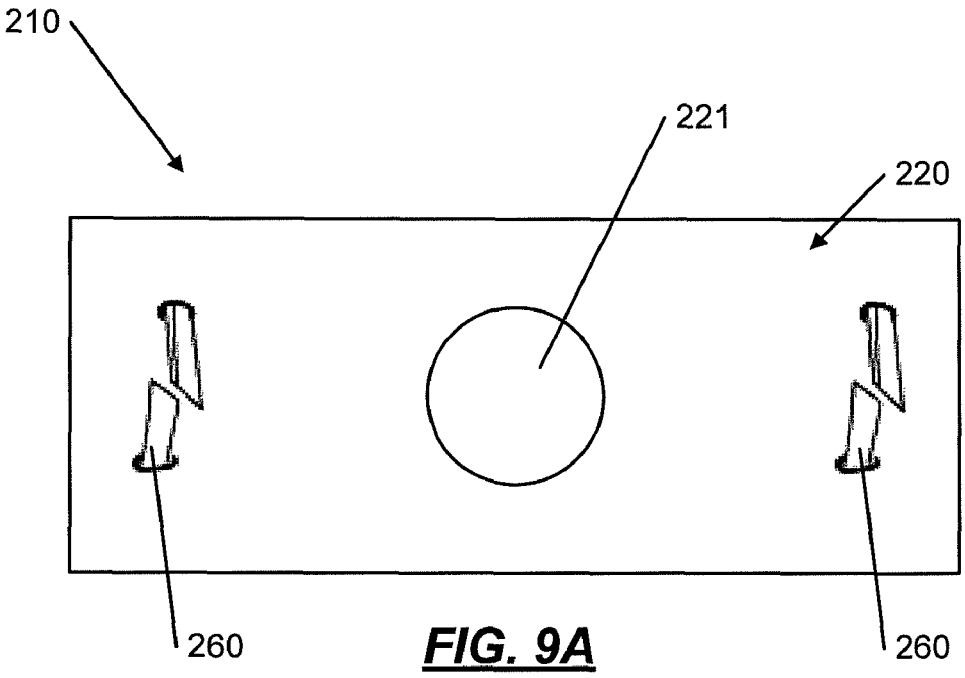
FIGS. 9A and 9B illustrate a top plan view of an example trapping device for use in a toilet bowl.
Figure 9B:
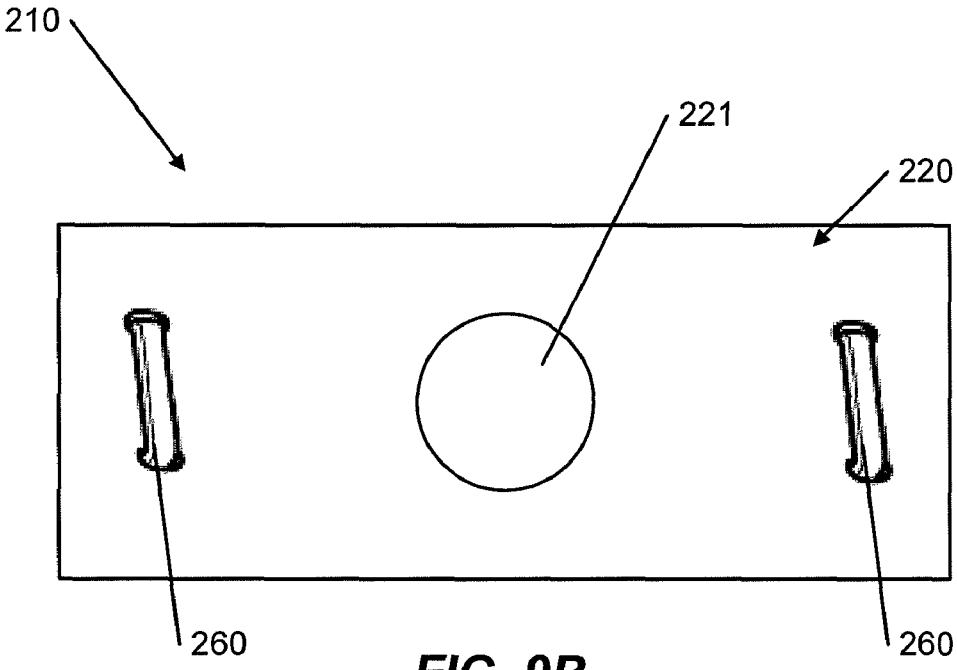

FIGS. 9A and 9B illustrate an example combination according to this invention similar to that described above in conjunction with FIGS. 1A-5 (the same or similar reference numbers are used in FIGS. 9 and 10 as those used in FIGS. 1A through 5 to denote the same or similar parts). FIG. 9A illustrates a front-view of a glue-in trapping device 210 for use in a toilet bowl 14. FIG. 9B illustrates a back-view of the glue-in trapping device 210. The glue-in trapping device 210 includes a mini-strap 220 and at least one hook 260. Each mini-strap 220 may be rectangular in shape with a hole 221 in the middle of the mini-strap 220. On each side of the hole 221, there may be two hooks 260 positioned vertically along the mini-strap 220. In this example, multiple mini-straps 220 may be installed in the toilet bowl trapway 12.

As shown in FIGS. 9A and 9B, the mini-strap 220 may be rectangular in shape and may be approximately ½"×1¼". The mini-strap 220 may be made of a number of different materials without departing from the scope of the present invention. The mini-straps 220 may be made of plastic, such as 30 mil HDPE to provide both strength and flexibility. Alternatively, the mini-straps 220 may also be made of metal. While the mini-strap 220 may be made of metal, some metals will corrode and rust when placed in a wet environment. The mini-strap 220 may be made of a stainless steel that may be non-corrosive in accordance with at least some examples of this invention. The hole 221 may be located in the center of the mini-strap 220 and aids in affixing the mini-strap 220 to the toilet bowl 14. The hole 221 may be approximately ¼" in diameter. The mini-strap 220 and hole 221 may be different shapes and sizes without departing from the scope of the present invention.

Additionally, as shown in FIGS. 9A and 9B, the mini-strap 220 may include at least one hook 260. The mini-strap 220 illustrated in FIG. 9 has two hooks 260, one on each side of the mini-strap 220. As was described above, the hooks 260 are used to catch and retain the non-dispersible cloths, while allowing other materials to pass by. The optimal angle for the hooks 260 is between approximately 45 and 60 degrees from the mini-strap 220 with the point of the hook 220 facing into the toilet bowl 14. The number, location, and angle of the hooks 260 can vary without departing from at least some examples of this invention.

As described above for FIGS. 1A-5, the hooks 260 may be made of a number of different materials without departing from the scope of the present invention. The hook material must be rigid and inflexible. Additionally, the hook material should be a non-corrosive material so that the hooks 260 do not rust in the wet environment. Also, the hooks 260 may be sharp, such as sharp enough to catch the non-dispersing cloths, while breaking or cutting through the toilet paper and waste in the toilet 14. Additionally, barbed hooks 260 may be used without departing from at least some examples of the invention. The barbed hooks 260 may have a "T" barb to catch the non-dispersing cloths. Through testing, the inventors have found that a heavy duty staple may be used for the hooks 260 (eg., Surebonder 5/16" stainless steel, No. 4, heavy duty, T50). Additionally, other materials may be used for the hooks 260 without departing from at least some examples of this invention, such as Velcro, fishing hooks, and plastic hooks. Each of these examples may have their drawbacks, but could be found effective if used in combination or in different numbers.

When installing the glue-in trapping device 210 as described above, the user places and holds the mini-strap 220 in a preferred location. The hole 221 in the mini-strap 220 allows for the epoxy to be squeezed through the mini-strap 220 when pressed against the toilet bowl 14 and flattened against the other side. This epoxy may form an epoxy "rivet"/head that holds the mini-strap 220 and the hooks 260 securely in place on the toilet bowl 14. The toilet bowl 14 should be completely dry to stick the epoxy. The epoxy may be an underwater epoxy, thereby allowing the epoxy to dry underwater and allowing for a quick installation and quick return to use for the toilet bowl 14. There may be four mini-straps 220 affixed to the top and sides of the toilet bowl trapway 12 and one additional mini-strap 220 may be affixed to the bottom of the trapway 12 for reasons as discussed above. Additionally, depending on the size of the toilet bowl 14, the number of mini-straps 220 can increase or decrease without departing from at least some examples of this invention. Additionally, a "mini-strap" mounting peg may be permanently attached, wherein the removable "mini-strap" may be affixed to the mounting pegs and changed out or replaced if damaged.

In another example trapping device 10 according to aspects of this invention, the strap 20 and the trapping device 10 as discussed above and illustrated in FIGS. 1A-5 may be built into the toilet 14 itself. For example, during the manufacturing process of the toilet bowl 14, the strap 20 and the trapping device 10 may be installed within the ceramic of the toilet bowl 14, thereby making the strap 20 and the trapping device 10 a permanent fixture of the toilet bowl 14.

In another example trapping device 10 according to aspects of this invention, the hooks 60 may be installed or formed integral to the toilet bowl 14. For example, during the manufacturing process of the toilet bowl 14, a plurality of hooks 60 may be singularly installed within the ceramic of the toilet bowl 14, thereby making the hooks 60 a permanent fixture of the toilet bowl 14. The location and number of hooks 60 may be similar to those as discussed above for FIGS. 1A-5. There may be approximately 5 to 6 hooks 60 spaced approximately 1" apart and located on the upper and side portions of the toilet bowl trapway 12, with one additional hook 60 located on the bottom of the toilet bowl trapway 12. In this example, the hooks 60 may be made of the same materials as discussed above or may be made of a material similar to or the same as the material of the toilet bowl.

CONCLUSION

The present invention is disclosed above and in the accompanying drawings with reference to a variety of examples. The purpose served by the disclosure, however, is to provide an example of the various features and concepts related to the invention, not to limit the scope of the invention. One skilled in the relevant art will recognize that numerous variations and modifications may be made to the aspects described above without departing from the scope of the present invention, as defined by the appended claims.

We claim:

1. A trapping device for trapping non-dispersing cloths in a toilet bowl comprising:

a strap defined by a leading edge and a trailing edge, said strap having a first end, a second end, and a middle portion, wherein the second end includes a plurality of adjustment holes, and the middle portion being rounded outwardly at, at least one of the leading edge and the trailing edge;

a plurality of hooks attached to an inner wall of the strap, wherein the hooks extend at an angle between approximately 45-60 degrees from the strap; and an adjustment buckle attached to the first end of the strap, wherein the second end of the strap slides through the adjustment buckle to adjust the diameter of the strap in order to fit around a drainage opening of a toilet bowl with said hooks positioned for catching the cloths as they pass through the opening.

2. The trapping device according to claim 1, wherein the middle portion includes a polymer band located along a leading edge of a side of the middle portion.

3. The trapping device according to claim 1, wherein the adjustment buckle includes a front tab that prevents the trapping device from being pushed down the toilet bowl.

4. The trapping device according to claim 1, wherein the adjustment buckle includes a set of front guides configured to receive the second end of the strap.

5. The trapping device according to claim 4, wherein the front guides are sized such that the hooks do not interfere with the front guides when the second end slides through the adjustment buckle.

6. The trapping device according to claim 5, wherein the hooks can be in the same lateral space with the front guides when the second end slides through the adjustment buckle.

7. The trapping device according to claim 1, further comprising an adjustment connector that slides through the adjustment buckle and adjustment holes to secure the diameter of the trapping device.

8. The trapping device according to claim 1, wherein the plurality of hooks comprises at least five hooks.

9. A system for trapping non-dispersing cloths in a toilet bowl, the system comprising:

a trapping device installed in the toilet bowl, the trapping device comprising:

a strap defined by a leading edge and a trailing edge, said strap having a first end, a second end, and a middle portion, wherein the second end includes a plurality of adjustment holes, and the middle portion being rounded outwardly at, at least one of the leading edge and the trailing edge;

a plurality of hooks attached to an inner wall of the strap, and an adjustment buckle attached to the first end of the strap, wherein the second end of the strap slides through the adjustment buckle to adjust the diameter of the strap to match the diameter of the toilet bowl drain in order to fit around a drainage opening of a toilet bowl with said hooks positioned for catching the cloths as they pass through the opening.

10. The system according to claim 9, wherein the plurality of hooks extend at an angle between approximately 45-60 degrees from the strap.

11. A trapping device for trapping non-dispersing cloths in a toilet bowl comprising:

a strap defined by a leading edge and a trailing edge, said strap having a first end, a second end, and a middle portion, wherein the second end includes a plurality of adjustment holes, and the middle portion being rounded outwardly at, at least one of the leading edge and the trailing edge;

a plurality of hooks attached to an inner wall of the strap; and an adjustment buckle attached to the first end of the strap, wherein the second end of the strap slides through the adjustment buckle to adjust the diameter of the strap in order to fit around a drainage opening of a toilet bowl with said hooks positioned for catching the cloths as they pass through the opening.

12. The trapping device according to claim 11, wherein the second end of the strap includes a plurality of adjustment holes.

13. The trapping device according to claim 11, wherein the middle portion includes a band located along the leading edge of a side of the middle portion.

14. The trapping device according to claim 11, wherein the adjustment buckle includes a front tab which protrudes perpendicular from the strap.

15. The trapping device according to claim 11, wherein the adjustment buckle includes a set of front guides configured to receive the second end of the strap, and wherein the front guides are sized such that the hooks can be in the same lateral space and the hooks do not interfere with the front guides when the second end slides through the adjustment buckle.

16. The trapping device according to claim 11, further comprising an adjustment connector that slides through the adjustment buckle and the adjustment holes to secure the diameter of the trapping device.

17. The trapping device according to claim 16, wherein the adjustment connector is a plastic rivet.

18. The trapping device according to claim 11, wherein the strap is constructed of high density polyethylene plastic.

* * * * *